US006336835B1

(12) United States Patent
Naganuma

(10) Patent No.: US 6,336,835 B1
(45) Date of Patent: Jan. 8, 2002

(54) STEERING SYSTEM OF OUTBOARD MOTOR

(75) Inventor: Koji Naganuma, Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/577,494

(22) Filed: May 25, 2000

(30) Foreign Application Priority Data

May 31, 1999 (JP) ..... 11-153043
May 25, 1999 (JP) ..... 11-145647

(51) Int. Cl.[7] ..... B63H 5/125
(52) U.S. Cl. ..... 440/53
(58) Field of Search ..... 440/53, 63, 900, 440/86; 114/144 R

(56) References Cited

U.S. PATENT DOCUMENTS 2,526,946 A * 10/1950 Hawkins ..... 74/480
2,528,480 A * 10/1950 Wilson et al. ..... 440/86
2,553,204 A * 5/1951 Murphy, Jr. ..... 74/515 R
2,600,852 A * 6/1952 Coots ..... 74/471 R
2,729,186 A * 1/1956 Kloss ..... 440/53
3,073,278 A * 1/1963 Brewster ..... 440/86
3,121,415 A * 2/1964 Anderson et al. ..... 440/59
3,174,357 A * 3/1965 Conklin ..... 74/480 B
4,496,326 A * 1/1985 Boda ..... 440/62
5,413,062 A * 5/1995 Koss ..... 114/144 A
5,498,181 A * 3/1996 Anselm et al. ..... 440/53
5,545,064 A * 8/1996 Tsunekawa et al. ..... 440/53
6,093,066 A * 7/2000 Isogawa et al. ..... 440/63

FOREIGN PATENT DOCUMENTS

GB 2031362 * 4/1980 ..... 440/63
JP 4-38294 * 2/1992 ..... 440/63
JP 5-97094 * 4/1993 ..... 440/900

OTHER PUBLICATIONS

The Evinrude–Elto Product Catalog, Outboard Motor Corp., Wis., USA, Feb. 1935, pp. 11–13.

* cited by examiner

*Primary Examiner*—S. Joseph Morano
*Assistant Examiner*—Ajay Vasudeva
(74) *Attorney, Agent, or Firm*—Oblon, Spivak, McClelland, Maier & Neustadt, P.C.

(57) ABSTRACT

A steering system is mounted to a body of an outboard motor and includes a steering bracket mounted at a rear side thereof to the body of the outboard motor which is mounted to a hull, a steering shaft to which the steering bracket is mounted to be rotatable, and a steering handle secured to a front side of the steering bracket. The steering bracket is provided with a front overhang portion which extends forward from the steering shaft and supports the steering handle and the front overhang portion is arranged to be offset sideways from a center line of the body of the outboard motor as viewed in a plan view.

7 Claims, 7 Drawing Sheets

STEERING SYSTEM OF OUTBOARD MOTOR

BACKGROUND OF THE INVENTION

The present invention relates to a steering system of an outboard motor including a steering handle for steering the outboard motor.

Some types outboard motors are provided with steering systems or apparatus each of which is manually operated by using a bar-like steering handle.

FIG. 7 is a plan view showing a conventional steering system of the above type, and with reference to FIG. 7, a steering bracket 92 is fixed to a front portion, i.e. hull side, of an outboard motor body (e.g. engine holder in FIG. 7) 91, a steering unit 93 is fixed to a front portion of the steering bracket 92 and a steering handle 94 extends forwardly from the side face of the steering unit 93 of the outboard motor. An engine is mounted on an upper portion of the engine holder and the like to which the steering bracket 92 is connected.

The steering bracket 92 is fixed to an upper end of a steering shaft 95 so as to be rotated together. The steering shaft 95 is rotatably supported by a clamp bracket (swivel bracket, not shown) which is fixed to a hull. If the steering handle 94 is turned to left or right, the outboard motor body 91 is turned around the steering shaft 95 and the hull is steered.

Conventionally, the steering bracket 92 is formed substantially symmetrically in a lateral direction with respect to a center line C of the outboard motor body 91. In such steering system, a steering unit 93 is omitted, and the steering handle 94 extends directly from a side of the steering bracket 92.

If parts, including such as oil filter, which are detachably attached to the engine of the outboard motor, are provided on a front surface of the engine, these parts are easy for a passenger to access and easy to be attached and detached, and this design facilitates maintenance. Especially, in the case of the oil filter, it is necessary to dispose the oil filter in the vicinity of an oil pump which is disposed in a lower portion of the engine, and it is ideal to dispose the oil filter on the front surface side of the lower portion of the engine.

However, in the conventional steering system, the steering bracket 92 is formed substantially symmetrically in the lateral direction with respect to the center line C of the outboard motor body 91 as described above. Therefore, even if an attempt is made to dispose the oil filter, for example, on the front surface of the lower portion of the engine which is mounted directly above the engine holder to which the steering bracket 92 is connected, it is difficult to dispose the oil filter or like due to the existence of the steering bracket 92, and even if such part or equipment could be disposed in such a position, it is difficult to access, and therefore, the maintenance performance (attaching and detaching operability) will be deteriorated.

Furthermore, some types of the outboard motors are provided with shifting (shift) device for interrupting the rotating force from the drive shaft to the propeller shaft or changing the rotational direction.

Such shift device is controlled remotely by a shift lever, which is usually arranged as a part of a remote-control unit at a portion near a steering seat in a large-sized ship or like, and on the other hand, in a small-sized ship or like, the shift lever is usually secured to a steering handle or steering bracket to which the steering handle is mounted. These members are integrally provided for the outboard motor, as disclosed, for example, in Japanese Patent Laid-open Publication No. HEI 6-144375 or No. HEI 10-218088), in each of which the shift device is operated through link means such as shift rod or shift cable extending from the shift lever.

In such conventional structure, however, in which the shift lever is secured to the sheering handle or steering bracket, no means is adopted for protecting the link means against force or impact from a horizontal side, for example.

Further, when the link means such as shift lever, shift rod or shift cable is broken, bent or cut, it is difficult to expect a suitable or steady clutching operation.

SUMMARY OF THE INVENTION

It is a primary object of the present invention is to substantially eliminate defects or drawbacks encountered in the prior art mentioned above and to provide a steering system arranged so as to make it possible to dispose an oil filter or like on a front surface of a lower portion of an engine in a state of an outboard motor mounted to a hull so as to facilitate the attaching and detaching operation of the oil filter or like.

It is another object of the present invention to provide a steering system of an outboard motor capable of protecting the oil filter or like disposed on the front surface of the lower portion of the engine against damage.

It is a further object of the present invention is to provide a steering system of an outboard motor provided with an improved steering handle and other operating members on a steering bracket.

It is a still further object of the present invention to provide a steering system of an outboard motor to facilitate maintenance of the steering handle and associated members or portions thereof.

It is a still further object of the present invention is to provide a steering system provided with a handle structure capable of protecting a shift lever and link means against impact or damage.

These and other objects can be achieved according to the present invention by providing, in one aspect, a steering system mounted to a body of an outboard motor comprising:

- a steering bracket mounted, at one side thereof, to the body of the outboard motor which is mounted to a hull;
- a steering shaft to which the steering bracket is mounted to be rotatable; and
- a steering handle secured to another one side of the steering bracket,
- the steering bracket being provided with a front overhang portion which extends forward from the steering shaft and supports the steering handle, the front overhang portion being arranged to be offset sideways from a center line of the body of the outboard motor as viewed in a plan view.

In a preferred embodiment of this aspect, the steering bracket is arranged such that the steering handle is disposed to be offset on an opposite side from the front overhang portion with respect to the center line.

The front overhang portion is provided, at a front end thereof, with a yoke extending in a widthwise direction of the body of the outboard motor, the front overhang portion and the yoke are arranged so as to provide a substantially T-shape as viewed on a plane, and the steering handle is provided on one side of the yoke. A shift lever is provided on another side of the yoke, and the yoke is detachably mounted to the front overhang portion. The yoke is mounted, at one end thereof, with a steering holder to which the steering handle is attached to be rotatable.

The steering bracket is provided with a pair of rear overhang portions extending rearward from the steering shaft.

According to this aspect of the present invention, since the front overhang portion of the steering bracket, on which the steering handle is supported is offset sideways with respect to the center line of the outboard motor body as viewed on a plane, a member or part such as the oil filter can be disposed on the front surface of the lower portion of the engine, and the attaching and detaching operation thereof can be facilitated.

Furthermore, in the steering system of the outboard motor of the present invention, since the steering bracket is formed such that the steering handle is offset towards the opposite side from the front overhang portion with respect to the center line of the outboard motor body as viewed in the longitudinal direction, the parts disposed on the front surface of the lower portion of the engine can be guarded and protected against damage.

Still furthermore, the front overhang portion is provided at its front end with the yoke extending in the widthwise direction of the outboard motor, and the front overhang portion and the yoke provide a substantially T-shape as viewed on a plane, the steering handle is provided on one side of the yoke, and the other operating member such as shift means is provided on the other side thereof. Therefore, it is possible to dispose the steering handle and the other operating member on the steering bracket efficiently.

Furthermore, since the yoke is detachably mounted to the front overhang portion, it is possible to facilitate maintenance of the steering handle and surrounding portions thereof.

The objects of the present invention can be also achieved by providing, in another aspect, a steering system mounted to a body of an outboard motor comprising:

- a steering bracket mounted at one side thereof to the body of the outboard motor which is mounted to a hull;
- a steering shaft to which the steering bracket is mounted to be rotatable;
- a steering handle secured to another one side of the steering bracket;
- a shift device adapted to control a rotational motion of a propeller means of the outboard motor; and
- a shift lever operatively connected to the shift device through a link means,
- the steering bracket being provided with a frame member in which the shift lever and the link means are accommodated.

In a preferred embodiment of this aspect, the shift lever is provided with a rotation shaft which is disposed to an inner upper portion of the frame member and the shift lever is provided with a connection portion for the link means, the connection portion being arranged inside the frame member. The rotation shaft comprises a fastening bolt having a head portion, the shift lever is formed with a recessed portion in which the head portion is accommodated and the shift lever is mounted to the frame member to be rotatable in a state that the head portion of the fastening bolt is accommodated in the recessed portion.

The link means includes a shift rod and shift cable connecting the shift lever and the shift device.

According to this aspect, since the shift lever for operating the shift device is disposed inside the frame member widened horizontally on the side portion of the steering bracket, an impact applied to the shift lever, for example, from the horizontal direction can be protected by the frame member. The connection portion formed to the shift lever for the link means is disposed inside the frame member, a horizontal impact applied to the shift rod can be also protected by the frame member.

Furthermore, since the shift lever is formed with the recessed portion which has a size allowing the head portion of the fastening bolt to be accommodated and the shift lever is mounted to the frame member to be rotatable, a horizontal impact applied to the head portion of the fastening bolt can be protected by the shift lever.

The nature and further characteristic features of the present invention will be made clear from the following descriptions made with reference to the accompanying drawings.

DESCRIPTION OF THE PREFERRED EMBODIMENTS

Figure 1:
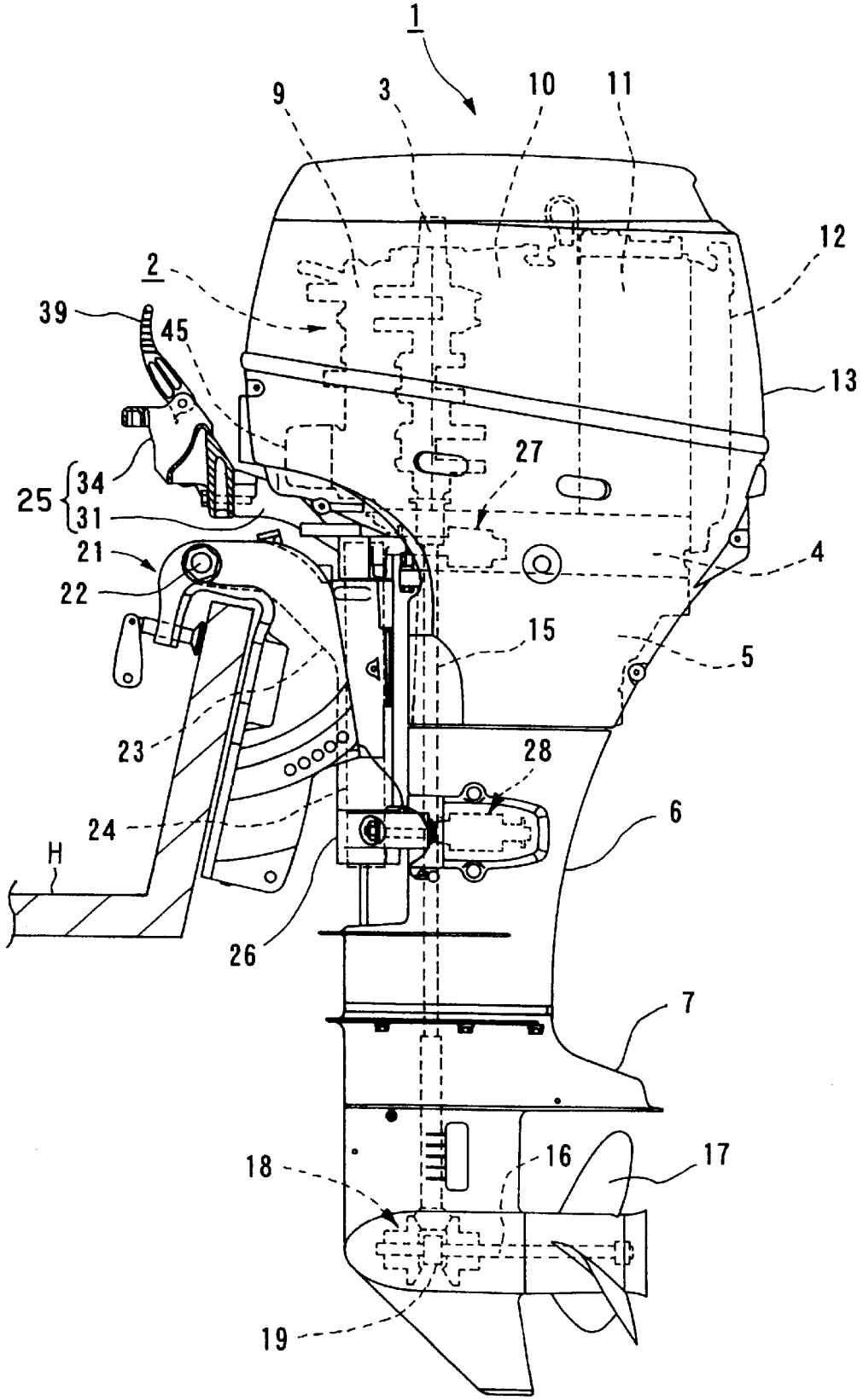
FIG. 1 is a left side view showing one example of an outboard motor to which a first embodiment of a steering system according the present invention is applicable.
Figure 2:
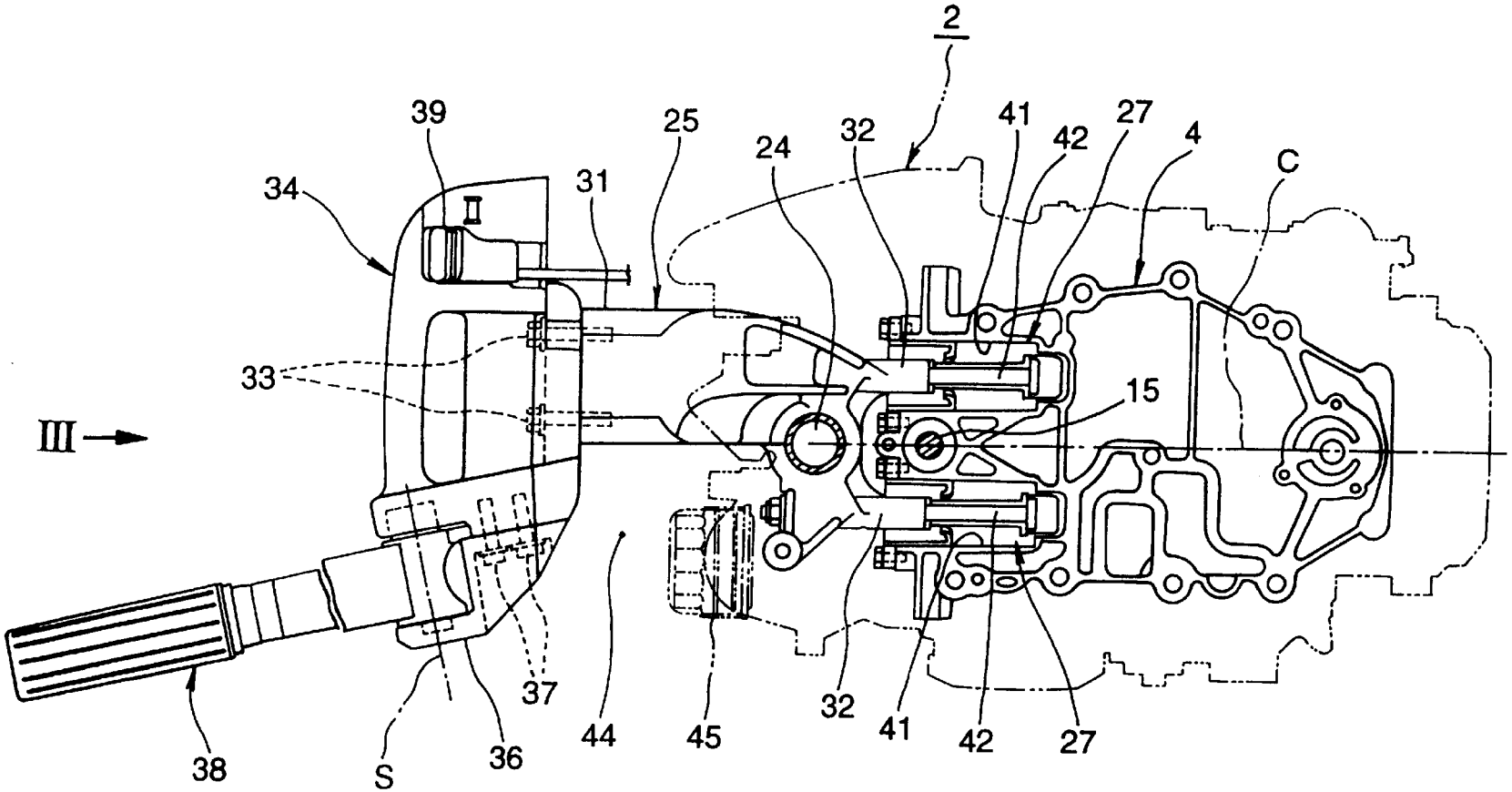
FIG. 2 is a plan view of the steering system in the state mounted to a body of the outboard motor.
Figure 3:
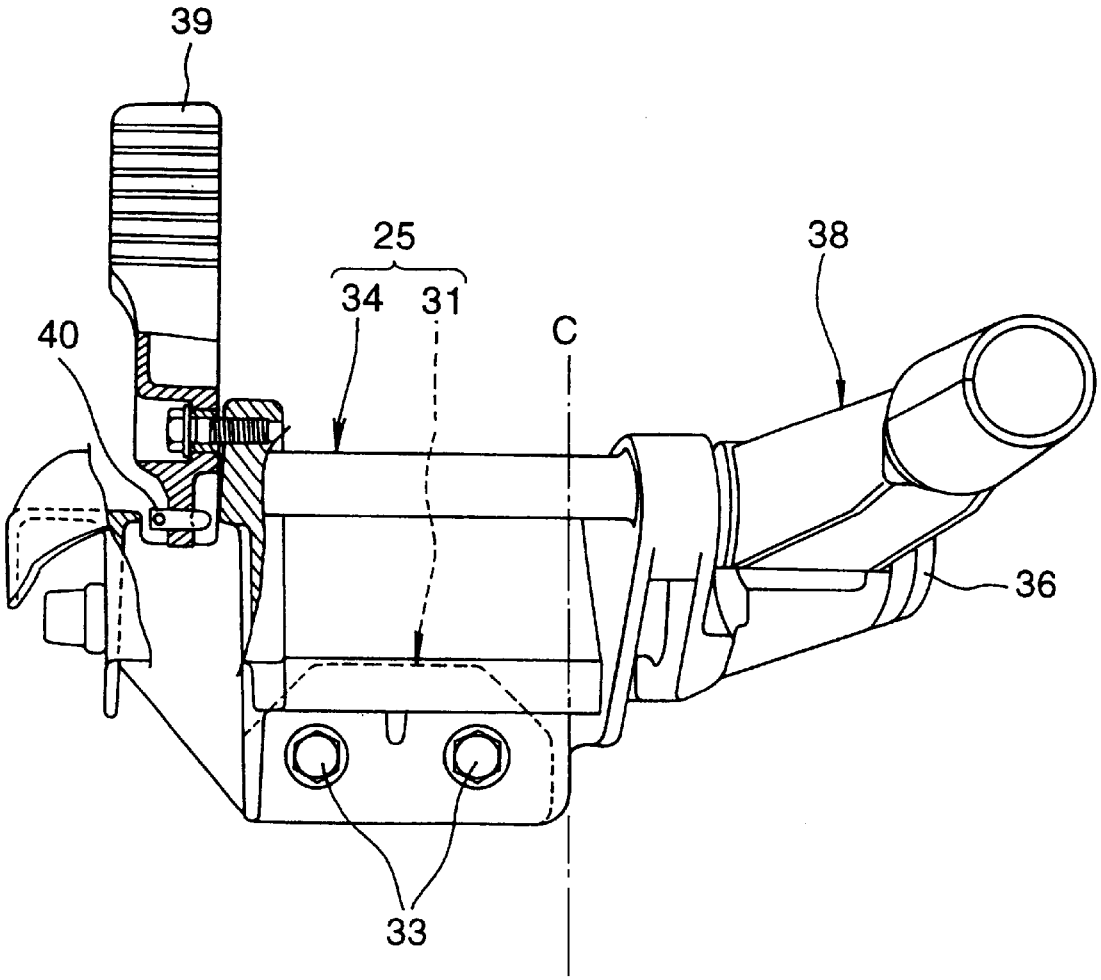
FIG. 3 is a front view of the steering system as viewed from a direction of an arrow III in FIG. 2.

A first embodiment of the present invention will be first described hereunder with reference to FIGS. 1–3.

An engine 2 mounted in the uppermost portion of an outboard motor 1 is an in-line three-cylinder four-stroke-cycle engine, for example. A crankshaft 3 of the engine 2 is uprightly mounted to a plate-like engine holder 4. An oil pan 5 is fixed on a lower surface of the engine holder 4. A drive shaft housing 6 and a gear housing 7 are fixed to the lower portion of the oil pan 5 in this order.

The engine 2 comprises a crankcase 9, a cylinder block 10, a cylinder head 11 and a head cover 12 arranged in this order from the front side (hull H side) of the engine 2. The entire engine 2, the engine holder 4 and the oil pan 5 are covered with an engine cover 13 for the purpose of waterproofing.

A drive shaft 15 is connected to a lower end of the crankshaft 3 of the engine 2 such that the drive shaft 15 is rotated in unison with the crankshaft 3. The drive shaft 15 extends downward to pass through the engine holder 4, the oil pan 5 and the drive shaft housing 6, and reaches into the gear housing 7. A propeller shaft 16 is pivotally supported in the gear housing 7 in the horizontal (longitudinal) direction, and a screw propeller 17 is provided on a rear end of the propeller shaft 16 to be rotatable together.

A bevel gear mechanism 18 and a clutch shifter 19 are provided on a portion where the drive shaft 15 intersects with the propeller shaft 16. Rotation of the drive shaft 15 is transmitted to the propeller shaft 16 through the bevel gear mechanism 18, and the screw propeller 17 is rotated to generate a propulsion force for the hull. The rotation of the drive shaft 15 is switched into the normal and reverse direction by the clutch shifter 19 and transmitted to the propeller shaft 16. Thus, a forward traveling or a backward traveling of the outboard motor 1 (hull H) is selected.

A clamp bracket 21 fixed to a stern plate of a boat, ship or like is provided on a front portion of a body of the outboard motor 1 having the above-described structure. A swivel bracket 23 is provided on the clamp bracket 21 through a tilt shaft 22. A steering shaft 24 is pivotally supported in the swivel bracket 23 in the vertical direction. Upper and lower ends of the steering shaft 24 are respectively provided with a steering bracket 25 and a lower bracket 26 to be rotatable together.

A pair of left and right upper mount unit 27 provided in the vicinity of a front edge of the engine holder 4 are connected to an upper mount bracket 25. Left and right sides of the drive housing 6 are provided with a pair of lower mount unit 28 which are connected to the lower bracket 26. With this design, the body of the outboard motor 1 can be turned (steered) laterally around the steering shaft 24 with respect to the clamp bracket 21 and can be tilted up around the tilt shaft 22.

With reference to FIGS. 2 and 3 as well as FIG. 1, the steering bracket 25 comprises one front overhang portion 31 extending forward from the position of the steering shaft 24, a pair of left and right rear overhang portions 32 extending rearward from the steering shaft 24, and a yoke 34 detachably fixed to a front end of the front overhang portion 31 by two fixing bolts 33.

The front overhang portion 31 is disposed such that it is offset sideways, i.e., on the right side of the center line C of the outboard motor body as viewed on a plane and the front overhang portion 31 does not exceed leftward the center line C. The yoke 34 is shaped so as to extend from the center line C substantially uniformly in left and right directions (widthwise direction of the boat or like), and the front overhang portion 31 and the yoke 34 form a substantially T-shape as viewed on a plane.

A steering holder 36 is fixed to one end of the yoke 34 by two fixing bolts 37, and a bar-like steering handle 38 is pivotally supported on the steering holder 36. The steering handle 38 can rotate around a horizontal shaft S and can jump up from a position extending forward in the drawing. Another operating member, e.g., a shift lever 39 is disposed on the other end of the yoke 34. The shift lever 39 is a lever to remotely operate the clutch shifter 19 through a rod 40.

The steering holder 36 provided on the yoke 34 is disposed such that the steering handle 38 is offset on the opposite side provide the front overhang portion 31 with respect to the center line C as viewed in the longitudinal direction. That is, when the front overhang portion 31 is offset rightward with respect to the center line C as in this embodiment, the steering holder 36 is offset leftward with respect to the center line C.

On the other hand, in the vicinity of the front edge of the engine holder 4, a pair of left and right mount insertion portions 41 are formed into columnar shape so as to sandwich the drive shaft 15, the upper mount unit 27 is inserted into the mount insertion portion 41 and resiliently held, and a center shaft 42 of the upper mount unit 27 is extended forwardly and connected to the rear overhang portion 32 of the steering bracket 25.

In the steering system having the structure described above, if the steering handle 38 is turned in right or left direction, the outboard motor 1 is turned around the steering shaft 24, thereby steering the hull H.

In this steering system, since the front overhang portion 31 of the steering bracket 25 is offset sideways (rightward) with respect to the center line C of the outboard motor body as viewed on a plane, the front overhang portion 31 is largely deviated sideways from the front portion of the front surface of the lower portion of the engine 2. Therefore, a vacant space 44 is formed in front of the front surface of the lower portion of the engine 2, and another part such as an oil filter 45 can be disposed on the front surface of the lower portion of the engine 2.

Since it is necessary to dispose the oil filter 45 in the vicinity of an oil pump (not shown) disposed on the lower portion of the engine 2, it is ideal to dispose the oil filter 45 on the front surface of the lower portion of the engine 2. Furthermore, since this position is easy to access if a passenger straighten his or her arm from the stern, attaching and detaching operation of the oil filter 45 is significantly facilitated, and it is possible to largely facilitate maintenance of the engine 2.

In the steering system of the present invention, since the steering handle 38 is offset toward the opposite side from the front overhang portion 31 as viewed in the longitudinal direction, a base (steering holder 36 and the like) of the steering handle 38 is located in front of the oil filter 45 provided on the front surface of the lower portion of the engine 2. Therefore, it is possible to guard and protect the oil filter 45 against damage.

Furthermore, the front overhang portion 31 and the yoke 34 form a substantially T-shape structure as viewed on a plane, the steering handle 38 is provided on one side of the yoke 34, and the shift lever 39 is provided on the other side. Therefore, it is possible to dispose the steering handle 38 and the shift lever 39 on the steering bracket 25 efficiently. The operating member (operating member for Power Trim and Tilt System and the like) other than the shift lever 39 may be provided on the yoke 34.

Further, since the yoke 34 is detachably provided on the front overhang portion 31, it is possible to make the steering handle 38, the shift lever 39 or the other operating member provided on the yoke 34 as one unit with the yoke 34, and such a unit can be detachably mounted to the front overhang portion 31. Therefore, it is possible to facilitate maintenance of the steering handle 38 and surrounding portions thereof.

Figure 4:
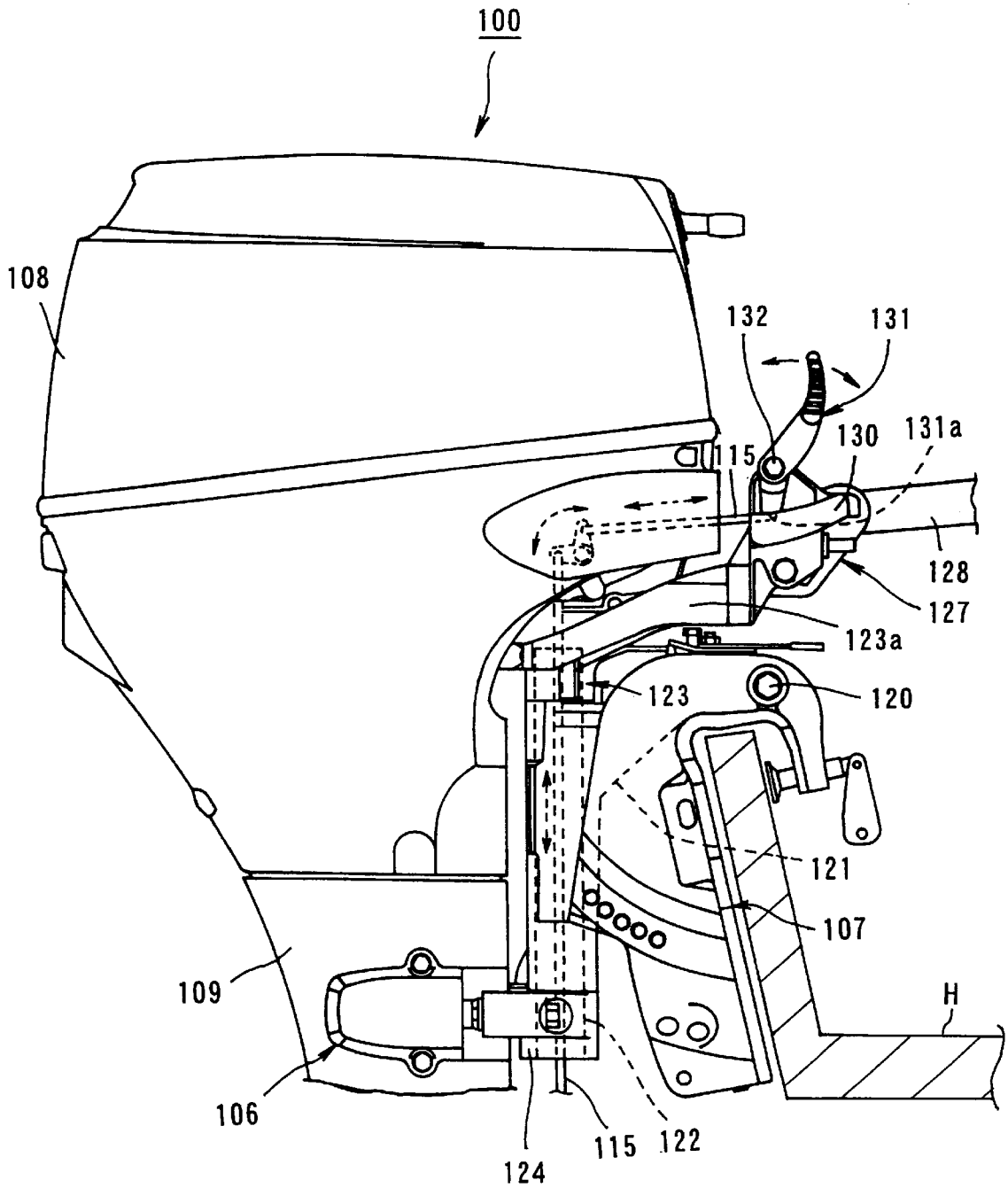
FIG. 4 is an enlarged view showing a steering system according to another embodiment of the present invention, which is applicable to the outboard motor shown in FIG. 1.
Figure 5:
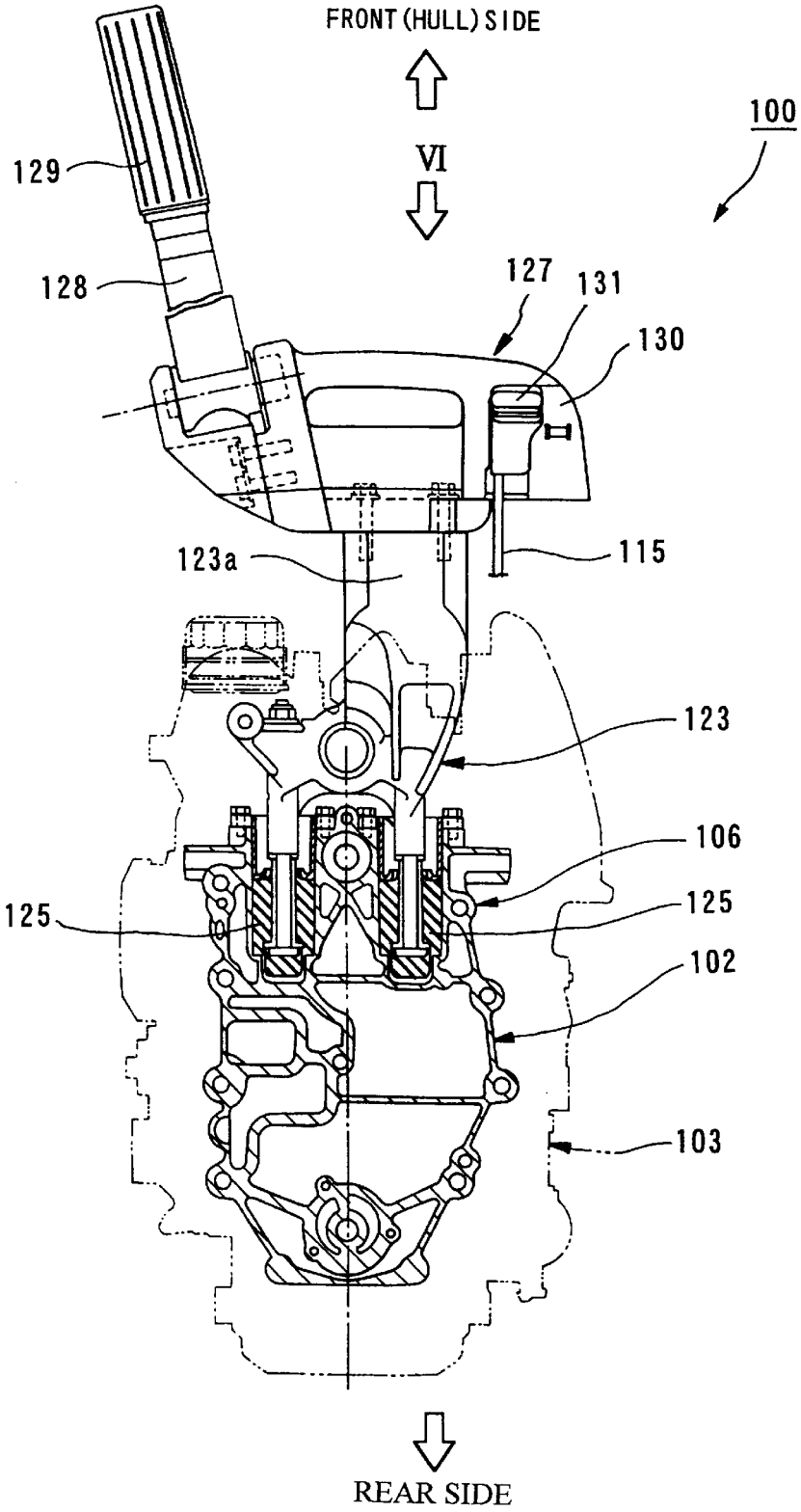
FIG. 5 is a sectional view showing a mounting state of the steering system of FIG. 4.
Figure 6:
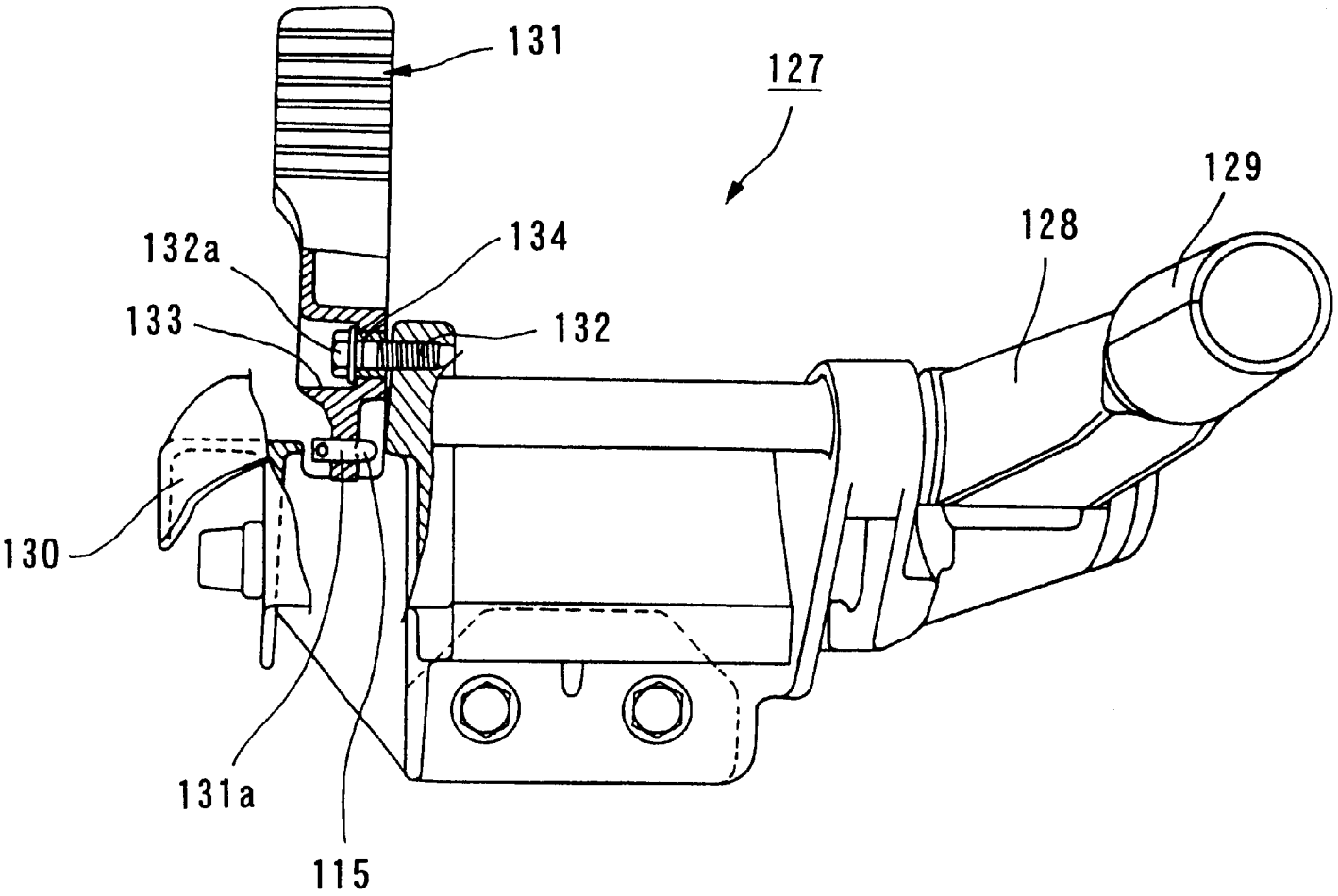
FIG. 6 is a view of the steering system as viewed from a direction of an arrow VI in FIG. 5.
Figure 7:
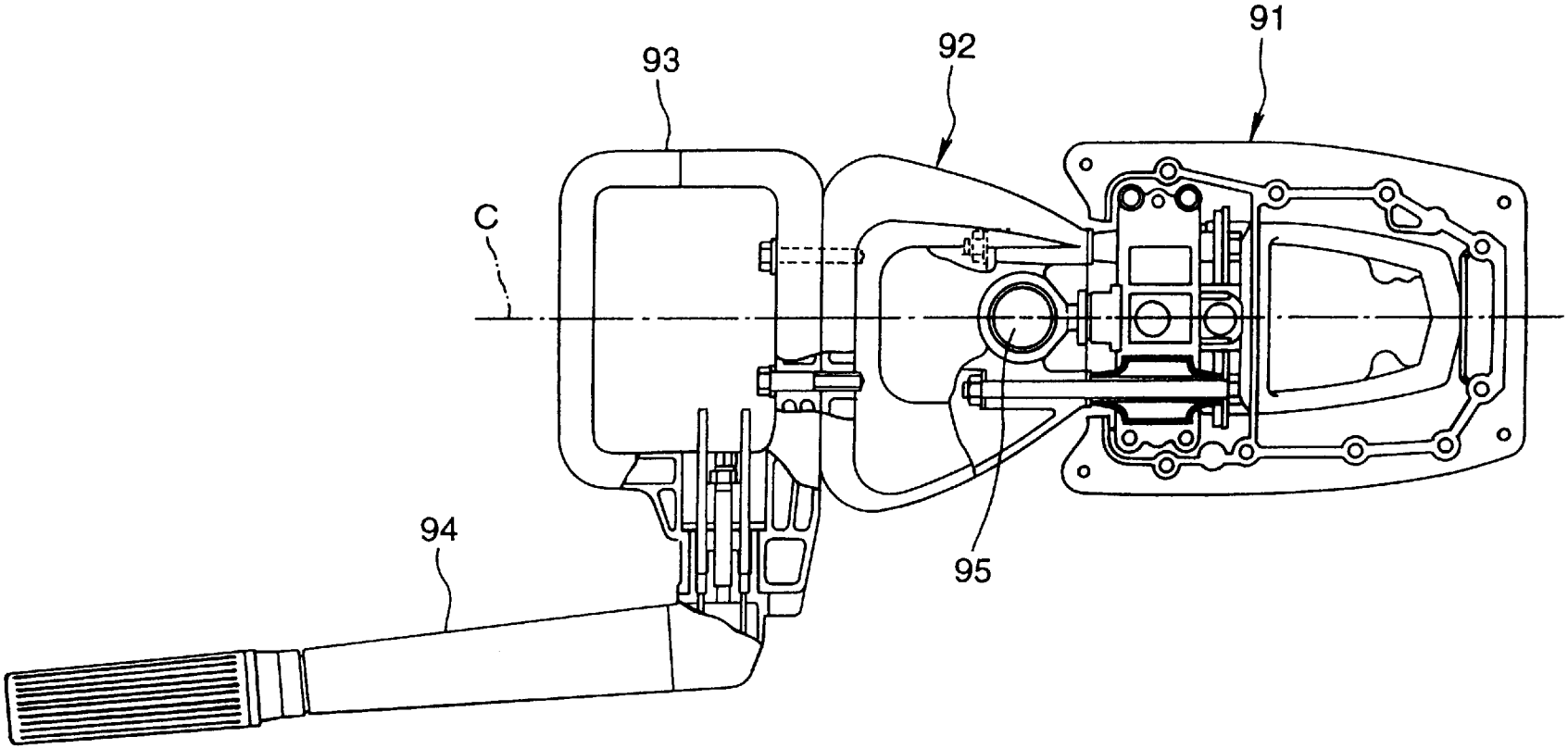
FIG. 7 PRIOR ART
FIG. 7 is a plan view of one example of a conventional steering system of an outboard motor.

FIGS. 4 to 6 represent a second embodiment of the present invention concerning the steering system particularly provided with an improved steering handle. Further, it is to be noted that, in this second embodiment, the outboard motor has a basic structure or arrangement (comprises essential elements) substantially corresponding to those of the first embodiment such as shown in FIG. 1, so that the explanation thereof is omitted herein.

FIG. 4 is a right side view of an outboard motor 100 in an enlarged scale, FIG. 5 is a sectional view of the steering handle in FIG. 4, and FIG. 6 is a view viewed from a direction of an arrow VI in FIG. 5. Further, in FIG. 4, a hull is positioned on the right side on the drawing.

With reference to FIGS. 4 to 6, a clamp bracket 107 is mounted to the outboard motor 100 (body of the outboard motor) through a mount device 106. A swivel bracket 121 is provided for the clamp bracket 107 through a tilt shaft 120, and a pilot shaft 122 is perpendicularly arranged in the swivel bracket 121 and supported thereto to be rotatable or pivotal. Upper and lower mount brackets 123 and 124 are mounted to the upper and lower end portions of the pilot shaft 122 so as to be rotatable together. The pilot shaft 122 has an inner hollow structure, in which a shift rod 115 as a link means is disposed. Further, a shift device 116 is disposed in a gear housing (corresponding to the gear housing 7 in FIG. 1) and adapted to shift the rotational direction of a propeller shaft and a propeller, not shown, but corresponding to the propeller shaft 16 and the propeller 17 of the first embodiment, to be forward, reverse or neutral, through a remote control operation by way of the link means.

A bilateral pair of upper mount units 125 is arranged to a front portion of the engine holder, which is connected to the upper mount bracket 123, and a bilateral pair of lower mount units 126 is also arranged to both side portion of the drive shaft housing, which is connected to the lower mount bracket 124.

The upper mount bracket 123 is formed, at a front portion thereof, integrally with an arm portion 123*a* extending forward, and a steering bracket 127 is formed to the front end of the arm portion 123*a*. To one side portion, i.e. left side portion in this embodiment towards an advancing direction of the hull, is disposed an steering handle 128 extending forward, to the front end portion of which a throttle grip 129 is provided.

When the steering handle 128 is swung in the bilateral direction, the outboard motor 100 can be steered bilaterally with the pilot shaft being the center with respect to the clamp bracket 107, and furthermore, can be tilted upward towards the center of the tilt shaft 120.

A U-shaped, in a plan view, frame member 130 is integrally formed to a side portion of the steering bracket 127 opposite to the steering handle 128. The U-shaped frame member 130 is widened in the horizontal direction at the right side towards the advancing direction of the hull H in FIG. 4 and the opened portion thereof is directed, for example, to the rearward direction. A shift lever 131 operating the shift device 116 through the shift rod 115 is disposed in side the frame member 130.

As shown in FIG. 6, the shift lever 131 is formed with a recessed portion 133 having a size allowing a head portion 132a of a fastening bolt 132 to be accommodated, this fastening bolt 132 also acting as a rotation shaft. The shift lever 31 is secured to the upper portion of the frame member 130 on the side (inside) of the steering handle 128 through a spacer 134 to be rotatable in the forward and backward direction by means of the fastening bolt 132 as shown in FIG. 4.

Furthermore, the shift lever 130 arranged in the frame member 130 has a lower end portion to which a connection portion 131*a* for the shift rod 115 is formed and the end portion of the shift rod 115 is connected to the connection portion 131*a*.

This second embodiment will attain the following functions and effects.

Since the shift lever 131 for operating the shift device is disposed inside the frame member 130 widened horizontally on the side portion of the steering bracket 127, an impact applied to the shift lever 131, for example, from the horizontal direction can be protected by the frame member 130. The connection portion 131*a* of the shift rod as link means 115 formed to the shift lever 131 is disposed inside the frame member 130, a horizontal impact applied to the shift rod 115 can be also protected by the frame member 130.

Furthermore, since the shift lever 131 is formed with the recessed portion 133 which has a size allowing the head portion 132*a* of the fastening bolt 132 to be accommodated and the shift lever 131 is mounted to the frame member 130 to be rotatable, a horizontal impact applied to the head portion 132*a* of the fastening bolt 132 can be protected by the shift lever 131.

Further, in the above embodiment, the frame member 130 may be formed so as to have a shape in a plan view other than the U-shape and the frame member 130 may be mounted to the steering handle 128 other than the steering bracket 127.

It is to be noted that the present invention is not limited to the described embodiments and many other changes and modifications may be made without departing from the scopes of the appended claims.

What is claimed is:

1. A steering system mounted to a body of an outboard motor comprising:

a steering bracket mounted at one side thereof to the body of the outboard motor which is mounted to a hull;

a steering shaft to which said steering bracket is mounted to be rotatable; and a steering handle secured to another one side of said steering bracket, said steering bracket being provided with a front overhang portion which extends forward from the steering shaft and supports the steering handle, said front overhang portion being arranged to be offset sideways from a center line of the body of the outboard motor as viewed in a plan view, wherein said steering bracket is arranged such that said steering handle is disposed to be offset on an opposite side from said front overhang portion with respect to said center line.

2. A steering system mounted to a body of an outboard motor comprising:

a steering bracket mounted at one side thereof to the body of the outboard motor which is mounted to a hull;

a steering shaft to which said steering bracket is mounted to be rotatable; and a steering handle secured to another one side of said steering bracket, said steering bracket being provided with a front overhang portion which extends forward from the steering shaft and supports the steering handle, said front overhang portion being arranged to be offset sideways from a center line of the body of the outboard motor as viewed in a plan view, wherein said front overhang portion is provided, at a front end thereof, with a yoke extending in a widthwise direction of the body of the outboard motor, said front overhang portion and said yoke are arranged so as to provide a substantially T-shape as viewed on a plane, and said steering handle is provided on one side of said yoke.

3. A steering system according to claim 2, wherein a shift lever is provided on another side of said yoke.

4. A steering system according to claim 2, wherein said yoke is detachably mounted to said front overhang portion.

5. A steering system according to claim 4, wherein said yoke is mounted, at one end thereof, with a steering holder to which said steering handle is attached to be rotatable.

6. A steering system mounted to a body of an outboard motor comprising:

a steering bracket mounted at one side thereof to the body of the outboard motor which is mounted to a hull;

a steering shaft to which said steering bracket is mounted to be rotatable; and a steering handle secured to another one side of said steering bracket, said steering bracket being provided with a front overhang portion which extends forward from the steering shaft and supports the steering handle, said front overhang portion being arranged to be offset sideways from a center line of the body of the outboard motor as viewed in a plan view, wherein said steering bracket is provided with a pair of rear overhang portions extending rearward from the steering shaft.

7. A steering system mounted to a body of an outboard motor comprising:

a steering bracket mounted at one side thereof to the body of the outboard motor which is mounted to a hull;

a steering shaft to which said steering bracket is mounted to be rotatable; and a steering handle secured to another one side of said steering bracket, said steering bracket being provided with a front overhang portion which extends forward from the steering shaft and supports the steering handle, said front overhang portion being arranged to be offset sideways from a center line of the body of the outboard motor as viewed in a plan view, wherein said steering bracket is arranged substantially entirely on one side of said center line, and said steering handle is disposed substantially entirely on another side of said center line.

* * * * *